US011198830B2

(12) United States Patent
Tanaka et al.

(10) Patent No.: US 11,198,830 B2
(45) Date of Patent: Dec. 14, 2021

(54) GREASE COMPOSITION

(71) Applicant: SHELL OIL COMPANY, Houston, TX (US)

(72) Inventors: Keiji Tanaka, Tokyo (JP); Kazuya Watanabe, Tokyo (JP)

(73) Assignee: SHELL OIL COMPANY, Houston, TX (US)

( * ) Notice: Subject to any disclaimer, the term of this patent is extended or adjusted under 35 U.S.C. 154(b) by 24 days.

(21) Appl. No.: 16/465,168

(22) PCT Filed: Nov. 30, 2017

(86) PCT No.: PCT/EP2017/080898
§ 371 (c)(1),
(2) Date: May 30, 2019

(87) PCT Pub. No.: WO2018/100020
PCT Pub. Date: Jun. 7, 2018

(65) Prior Publication Data

US 2019/0375998 A1 Dec. 12, 2019

(30) Foreign Application Priority Data

Dec. 1, 2016 (JP) ..... JP2016-234406

(51) Int. Cl.

| | |
|---|---|
| ***C10M 117/08*** | (2006.01) |
| ***C10M 117/02*** | (2006.01) |
| ***C10M 169/02*** | (2006.01) |
| *C10N 10/04* | (2006.01) |
| *C10N 50/10* | (2006.01) |

(52) U.S. Cl.
CPC ..... *C10M 117/08* (2013.01); *C10M 117/02* (2013.01); *C10M 169/02* (2013.01); *C10M 2203/1025* (2013.01); *C10M 2207/1225* (2013.01); *C10M 2207/1265* (2013.01); *C10M 2207/1415* (2013.01); *C10N 2010/04* (2013.01); *C10N 2050/10* (2013.01)

(58) Field of Classification Search
CPC ..... C10M 117/08; C10M 117/02; C10M 169/02; C10M 2203/1025; C10M 2207/1225; C10M 2207/1265; C10M 2207/1415; C10M 123/00; C10N 2010/04; C10N 2050/10; C10N 2030/06; C10N 2020/069; C10N 2030/08; C10N 2040/02
USPC ..... 508/525
See application file for complete search history.

(56) References Cited

U.S. PATENT DOCUMENTS

| | | | | |
|---|---|---|---|---|
| 9,290,715 | B2 | 3/2016 | Watanabe et al. | |
| 2011/0160105 | A1 | 6/2011 | Tanaka et al. | |
| 2014/0329730 | A1 | 11/2014 | Watanabe et al. | |
| 2015/0315509 | A1* | 11/2015 | Watanabe ..... | C10M 129/26 508/525 |
| 2018/0016517 | A1 | 1/2018 | Sawaguchi et al. | |

FOREIGN PATENT DOCUMENTS

| | | | |
|---|---|---|---|
| JP | 5343607 | B2 | 11/2013 |
| RU | 2023003 | C1 | 11/1994 |
| WO | 2016158071 | A1 | 10/2016 |

OTHER PUBLICATIONS

International Search Report and Written Opinion received for PCT Patent Application No. PCT/EP2017/080898, dated Mar. 21, 2018, 8 pages.

* cited by examiner

*Primary Examiner* — Prem G Singh
*Assistant Examiner* — Francis C Campanell
(74) *Attorney, Agent, or Firm* — Shell Oil Company

(57) ABSTRACT

The invention provides a grease composition, being a grease composition containing a base oil and, as a thickener a calcium complex soap, and being a grease composition using for the carboxylic acids forming the aforementioned calcium complex soap substituted or unsubstituted C18-22 straight-chain higher fatty acids, aromatic monocarboxylic aromatic acids having substituted or unsubstituted benzene rings and C2-4 straight-chain saturated lower fatty acids, wherein the aforementioned substituted or unsubstituted C18-22 straight-chain higher fatty acids include behenic acid and the amount of behenic acid used, as a mass ratio in terms of the total amount of the aforementioned substituted or unsubstituted C18-22 straight-chain higher fatty acids used, is from 25 mass % up to 70 mass %.

7 Claims, No Drawings

GREASE COMPOSITION

CROSS REFERENCE TO EARLIER APPLICATION

The present application is the National Stage (§ 371) of International Application No. PCT/EP2017/080898 filed Nov. 30, 2017, which claims priority from JP Application 2016-234406 filed Dec. 1, 2016 incorporated herein by reference.

FIELD OF THE INVENTION

This invention relates to a grease composition. More specifically it relates to a calcium complex based grease composition having superior shear stability and long bearing life, being thermally stable, and having good low-temperature flow characteristics.

BACKGROUND OF THE INVENTION

Recently, as machine technology has advanced, lubricating environments have become more severe and demands for improved performance at high temperatures have increased, and so greases satisfying these demands are being sought.

Amongst such greases, for example as regards lithium soap-based greases, lithium complexes with a broader usable temperature domain than lithium greases have been proposed, but recent demand for the raw material, lithium, has risen and there are concerns that in future supplies will become uncertain or prices will soar. Urea greases are also widely used as heat-resistant greases but the substances used as the raw materials include strongly toxic substances and great care is required in handling them during manufacture. What are sought therefore are materials that will form grease compositions endowed with heat resistance for which supplies are stable and environmental compatibility is high.

In the background art, Japanese Laid-open Patent 2013-136738 has disclosed a grease composition having extremely good oxidative stability and heat resistance (dropping point), being an art relating to calcium complex thickeners obtained by reacting three constituents, a higher fatty acid constituent, a lower fatty acid constituent and an aromatic carboxylic acid constituent, with calcium hydroxide.

However, the grease compositions pertaining to Japanese Laid-open Patent 2013-136738 are prone to soften at high temperatures if, for example, stearic acid is used for the higher fatty acid constituent, and so there have been cases where it cannot be said that actual performance has been satisfactory from the standpoint of bearing life. But in cases where an attempt has been made to extend the bearing life of the grease composition, it has been found difficult to achieve desirable flow characteristics for the grease (in particular, under low-temperature conditions).

The purpose of this invention has therefore been to offer a grease composition having stable lubricating functions in a broad temperature domain from the twin standpoints of bearing life and low temperature characteristics which constitute the practical performance of a grease.

SUMMARY OF THE INVENTION

This invention has been perfected after it had been discovered that, in a grease composition containing a specified calcium complex soap, by selecting a specified constituent as one of the higher fatty acids forming the calcium complex soap and setting a specified range for the mass ratio of the specified constituent as contained in the higher fatty acids, bearing life is significantly improved and, because it has good low-temperature characteristics, it has stable lubrication functions over a broad range of temperatures. In other words, the invention has the following aspects.

Aspect (1) of the invention is a grease composition, being a grease composition containing a base oil and, as a thickener a calcium complex soap, and being a grease composition using for the carboxylic acids forming the aforementioned calcium complex soap substituted or unsubstituted C18~22 straight-chain higher fatty acids, aromatic monocarboxylic acids having substituted or unsubstituted benzene rings and C2~4 straight-chain saturated lower fatty acids, wherein the aforementioned substituted or unsubstituted C18~22 straight-chain higher fatty acids include behenic acid and the amount of behenic acid used, as a mass ratio in terms of the total amount of the aforementioned substituted or unsubstituted C18~22 straight-chain higher fatty acids used, is from 25 mass % up to 70 mass %.

Aspect (2) of the invention is the grease composition of the aforementioned aspect (1) wherein the amount (mass) of the aforementioned carboxylic acids used has a relationship such that the aforementioned substituted or unsubstituted C18-22 straight-chain higher fatty acids>the aforementioned C2-4 straight-chain saturated lower fatty acids>the aforementioned aromatic monocarboxylic acids having substituted or unsubstituted benzene rings.

Aspect (3) of the invention is the grease composition of either of the aforementioned aspects (1) or (2) wherein the aforementioned straight-chain higher fatty acids other than behenic acid are one or more kinds selected from stearic acid, oleic acid and 12-hydroxystearic acid.

Aspect (4) of the invention is the grease composition of any of the aforementioned aspects (1) to (3) wherein the aforementioned aromatic monocarboxylic acids are one or more kinds selected from acetic acid and butyric acid, the aforementioned straight-chain saturated lower fatty acid is a compound of stearic acid and behenic acid, and the mass ratio of stearic acid and behenic acid is 75:25 to 30:70.

DETAILED DESCRIPTION OF THE INVENTION

According to this invention it is possible to offer a grease composition having stable lubricating functions in a broad temperature domain from the twin standpoints of bearing life and low temperature characteristics which constitute the practical performance of a grease.

A form of embodiment of the invention is explained in more detail below, but the range of the art of this invention is in no way limited to said form of embodiment.

The grease composition of this invention contains as its essential ingredients a "base oil" and a "thickener." An explanation is given below, in sequence, of each constituent included in the grease composition, the amounts (blending quantities) of each constituent in the grease composition, the method of manufacture of the grease composition, the properties of the grease composition and the applications of the grease composition.

There is no special restriction on the base oil used in the grease composition of the present embodiment. For example, it is possible to use the mineral oils, synthetic oils and animal or plant oils used in normal grease compositions.

Specifically, it is possible to use base oils belonging to Groups 1 to 5 in the base oil categories of the API (American Petroleum Institute).

Group 1 base oils include, for example, paraffinic mineral oils obtained by a suitable combination of refining processes such as solvent refining, hydrorefining and dewaxing on lubricating oil fractions obtained by atmospheric distillation of crude oil. Group 2 base oil include, for example, paraffinic mineral oils obtained by a suitable combination of refining processes such as hydrocracking and dewaxing on lubricating oil fractions obtained by atmospheric distillation of crude oil. Group 2 base oils refined by hydrofining methods such as the Gulf process have a total sulphur content of less than 10 ppm and an aromatics content of less than 5% and so may be suitably used for this invention. Group 3 and Group 2+ base oils include, for example, paraffinic mineral oils manufactured by a high degree of hydrorefining of lubricating oil fractions obtained by atmospheric distillation of crude oil, base oils refined by the Isodewax process which dewaxes by substituting the wax produced by the dewaxing process with isoparaffins, and base oils refined by the Mobil wax isomerisation process, and these too may be suitably used in the present embodiment.

As examples of synthetic oils mention may be made of polyolefins, diesters of dibasic acids such as dioctyl sebacate, polyol esters, alkylbenzenes, alkylnaphthalenes, esters, polyoxyalkylene glycols, polyoxyalkylene glycol esters, polyoxyalkylene glycol ethers, polyphenyl ethers, dialkyldiphenyl ethers, fluorine-containing compounds (perfluoropolyethers, fluorinated polyolefins) and silicone oils. The aforementioned polyolefins include polymers of various olefins or hydrides thereof. Any olefin may be used, and as examples mention may be made of ethylene, propylene, butene and α-olefins with five or more carbons. In the manufacture of polyolefins, one kind of the aforementioned olefins may be used singly or two or more kinds may be used in combination. Particularly suitable are the polyolefins called poly-α-olefins (PAO). These are Group IV base oils.

Oils obtained by means of a GTL (gas to liquid) synthesised by the Fischer-Tropsch method of converting natural gas to liquid fuel have a very low sulphur content and aromatic content compared with mineral oil base oils refined from crude oil and have a very high paraffin constituent ratio, and so they have excellent oxidative stability, and because they also have extremely small evaporation losses, they may be suitably used as base oils for the present embodiment.

The thickener used in the present embodiment is a calcium complex soap in which a plurality of carboxylic acids are reacted with a specified base (typically calcium hydroxide). What "complex" refers to here in the calcium complex soap pertaining to the present embodiment is using a plurality of carboxylic acids. The sources of the carboxylic acids in the calcium complex soap pertaining to the present embodiment are of three kinds: (1) higher fatty acids, (2) aromatic monocarboxylic acids and (3) lower fatty acids. An explanation is given below of the carboxylic acid moiety (anionic moiety) of said calcium complex soap.

(1) The higher fatty acids used in the present embodiment are C18-22 straight-chain higher fatty acids, and necessarily include behenic acid (docosanoic acid, C22) and higher fatty acids (C18-22 straight-chain higher fatty acids) other than behenic acid. Here, said higher fatty acids (straight-chain higher fatty acids) other than behenic acid may be unsubstituted or may have one or more substituted groups (for example, hydroxyl groups). Also, said straight-chain higher fatty acids may be saturated fatty acids or unsaturated fatty acids, but saturated fatty acids are ideal. As specific examples mention may be made, in the case of saturated fatty acids, of stearic acid (octadecanoic acid, C18), tuberculostearic acid nonadecanoic acid, C19), arachidinic acid (eicosanoic acid, C20), heneicosanoic acid (C21) and hydroxystearic acid (C18, castor hardened fatty acid), and, in the case of unsaturated fatty acids, oleic acid, linolic acid, linolenic acid (C18), gadoleic acid, eicosadienoic acid, Mead acid (C20), erucic acid and docosadienoic acid (C22).

In addition, the higher fatty acids other than behenic acid may be used as a single kind or in combinations of a plurality of kinds (in the case of using the higher fatty acids other than behenic acid as a plurality of kinds, the kinds of higher fatty acids will include behenic acid and so will be three or more). The higher fatty acids other than behenic acid may be those higher fatty acids mentioned above (saturated fatty acids and/or unsaturated fatty acids), but are ideally one or more kinds selected from stearic acid, oleic acid and 12-hydroxystearic acid (in other words, the higher fatty acids (1) are mixtures of behenic acid and one or more kinds of saturated fatty acids selected from stearic acid, oleic acid and 12-hydroxystearic acid), and mixtures with stearic acid (that is, the higher fatty acids of (1) are a mixture of behenic acid and stearic acid) are even better.

(2) The aromatic monocarboxylic acids used in the present embodiment are aromatic monocarboxylic acids having substituted or unsubstituted benzene rings. Said aromatic monocarboxylic acids here may be unsubstituted or have one or more substituted groups (for example, o-, m- or p-alkyl groups, hydroxy groups, alkoxy groups). As specific examples mention may be made of benzoic acid, methylbenzoic acid {toluic acid (p-, m-, o-)}, dimethylbenzoic acid (xylylic acid, hemellitc acid, mesitylenic acid), trimethylbenzoic acid {prehnitylic acid, durylic acid, isodurylic acid (α-, β-, γ-)}, 4-isopropylbenzoic acid (cuminic acid), hydroxybenzoic acid (salicylic acid), dihydroxybenzoic acid {pyrocatachuic acid, resorcylic acid (α-, β-, γ-), gentisic acid, protocatechuic acid}, trihydroxybenzoic acid (gallic acid), hydroxy-methylbenzoic acid {cresotic acid (p-, m-, o-)} dihydroxy-methylbenzoic acid (orsellinic acid), methoxybenzoic acid {anisic acid (p-, m-, o-)}, dimethoxybenzoic acid (veratric acid), trimethoxybenzoic acid (asaronic acid), hydroxy-methoxybenzoic acid (vanillic acid, isovanillic acid) and hydroxydimethoxybenzoic acid (syringic acid). These may be used as a single kind or in combination as a plurality of kinds. Of these, the aromatic monocarboxylic acids are ideally one kind or more selected from benzoic acid and para-toluic acid. The alkyl groups and the alkyl moieties in the alkoxy "substituent groups" in this specification are, for example, 1~4 straight-chain or branched alkyls.

(3) The lower fatty acids used in the present embodiment are C2~4 straight-chain saturated lower fatty acids. As specific examples mention may be made of acetic acid (C2), propionic acid (C3) and butyric acid (C4). Of these the ideal is one kind or more selected from acetic acid and butyric acid, and acetic acid (C2) is especially good. These too may be used as a single kind or as a plurality of kinds in combination.

Of these, from the standpoint of heightening the effect of the invention and also for better texture, viscoelasticity (grease body) and ease of manufacture, it is best to use mixtures with behenic acid where the aromatic monocarboxylic acid is one kind or more selected from benzoic acid and para-toluic acid, the straight-chain saturated fatty acid is one or more kind selected from acetic acid and butyric acid and the higher fatty acid is stearic acid.

It is also possible to use other thickeners together with the aforementioned calcium complex soap in the grease composition of the present embodiment. As examples of these other thickeners, mention may be made of tricalcium phosphate, alkali metal soaps, alkali metal complex soaps, alkaline earth metal soaps, alkaline earth metal complex soaps (apart from the calcium complex soap), alkali metal sulphonates, alkaline earth metal sulphonates, other metal soaps, metal terephthalate salts, clays, silicas (silicon oxides) such as silica aerogels, and fluororesins such as polytetrafluoroethylene. These may be used as one kind or in combinations of two or more kinds. It is also possible to use any other substances apart from these which can impart a thickening effect to the liquid matter.

Taking the total amount of the grease composition as 100 parts by mass, to the grease composition of the present aspect it is also possible to add, as optional constituents, approximately 0.1 to 20 parts by mass of additives such as any anti-oxidants, rust preventatives, oiliness agents, extreme pressure additives, anti-wear agents, solid lubricants, metal deactivators, polymers, metallic detergents, non-metallic detergents, defoamers, colourants and water repellents. Examples of anti-oxidants include 2,6-di-t-butyl-4-methylphenol, 2,6-di-t-butylparacresol, p,p'-dioctyldiphenylamine, N-phenyl-α-naphthylamine and phenothiazine. Examples of rust preventatives include paraffin oxides, metallic carboxylates, metallic sulphonates, carboxylate esters, sulphonate esters, salicylate esters, succinate esters, sorbitan esters and various amine salts. Examples of oiliness agents, extreme pressure additives and anti-wear agents include sulphurised zinc dialkyldithiophosphates, sulphurised zinc diaryldithiophosphates, sulphurised zinc dialkyldithiocarbamates, sulphurised zinc diaryldithiocarbamates, sulphurised molybdenum dialkyldithiophosphates, sulphurised molybdenum diraryldithiophosphates, sulphurised molybdenum dialkyldithiocarbamates, sulphurised diaryldithiocarbamates, organomolybdenum complexes, sulphurised olefins, triphenyl phosphate, triphenyl phosphorothionate, tricresyl phosphate, other phosphate esters and sulphurised fats. Examples of solid lubricants include molybdenum disulphide, graphite, boron nitride, melamine cyanurate, PTFE (polytetrafluoroethylene), tungsten disulphide and graphite fluoride. Examples of metal deactivators include N,N'-disalicylidene-1,2-diaminopropane, benzotriazole, benzoimidazole, benzothiazole and thiadiazole. As examples of polymers mention may be made of polybutene, polyisobutene, polyisoprene and polymethacrylate. As examples of metallic detergents mention may be made of metallic sulphonates, metallic salicylates and metallic phenates. As examples of non-metallic detergents mention may be made of succinimides. As examples of defoamers mention may be made of methyl silicone, dimethyl silicone, fluorosilicone and polyacrylate.

Given next is an explanation of the blended amounts in the grease composition pertaining to the present embodiment.

Taking the total grease composition as 100 parts by mass, the amount of base oil in the blend is preferably 60 to 99 parts by mass, but more preferably 70 to 97 parts by mass and even more preferably 80 to 95 parts by mass.

Taking the total amount of the grease composition as 100 parts by mass, the amount of calcium complex soap incorporated in the thickening agent is preferably 1 to 40 parts by mass, but more preferably 3 to 25 parts by mass, even more preferably 5 to 20 parts by mass.

The calcium complex soap pertaining to the present embodiment includes as essential constituents behenic acid and higher fatty acids other than behenic acid as the higher fatty acids (1). The amount of behenic acid used in terms of the total amount of higher fatty acids (1) used must be not less than 25 mass % and not more than 70 mass %.

Bearings are affected by a combination of chemical factors (poor lubrication due to oxidative ageing) and physical factors (leakage from the bearings because of softened grease), and it will be possible to bring about longer life by addressing these twin standpoints. The examples of embodiment under the art disclosed in the aforementioned Patent Reference 1 all have excellent thermal resistance and oxidative stability, but the inventors have discovered that if stearic acid (C18) is used as the higher fatty acid, this induces softening of the grease at high temperatures and there are occasions when bearing life is not satisfactory. When carrying out research using a variety of higher fatty acids in connection with calcium complex soaps in grease compositions, the inventors next discovered that, if behenic acid (C22) was used as a higher fatty acid rather than stearic acid (C18), the structural stability of the grease at high temperatures was higher, and so extended bearing life. Given that the solubility of behenic acid (C22) in base oil is greater than stearic acid (C18) because of its longer carbon chains, it would appear that the fibre structure of the thickening agent becomes stronger and this is a factor in maintaining a high performance of the base oil. However, it was discovered that when behenic acid was used as a higher fatty acid, the grease structure is firmer and so there are times when the flow characteristics of the grease at low temperatures are reduced. Therefore, by dint of further repeated investigations, the inventors discovered that, in a grease composition using substituted or unsubstituted C18~C22 straight-chain higher fatty acids as the carboxylic acid to form a calcium complex soap, aromatic monocarboxylic acids having substituted or unsubstituted benzene rings, and C2~4 straight-chain saturated lower fatty acids, by incorporating as the higher fatty acids two or more kinds of higher fatty acids which include behenic acid, and by making the mass ratio of the behenic acid in the higher fatty acids from 25 mass % up to 70 mass %, it is for the first time possible to exhibit stable lubricating functions over a broad temperature domain as regards both bearing life and low-temperature characteristics.

On the basis of the foregoing considerations, the mass ratio of the behenic acid in the higher fatty acids is to be 25 to 70 mass %, but 40 to 55 mass % is ideal.

The calcium complex soap pertaining to the present embodiment is a mixture of stearic acid and behenic acid, and in particular if the aromatic monocarboxylic acid is one or more kind selected from benzoic acid and para-toluic acid and the aforementioned straight-chain saturated lower fatty acid is one or more kind selected from acetic acid and butyric acid, the ideal mass ratio of the stearic acid and behenic acid will be 75:25 to 30:70.

Also, the calcium complex soap pertaining to the present embodiment, as explained above, uses three things: (1) higher fatty acids (substituted or unsubstituted C18~C22 straight-chain higher fatty acids), (2) aromatic monocarboxylic acids (aromatic monocarboxylic acids having substituted or unsubstituted benzene rings) and (3) lower fatty acids (C2~4 straight-chain saturated lower fatty acids), and ideally the amount (mass) of carboxylic acids used is such as to form the relationship (1) higher fatty acids >(2) lower fatty acids >(3) aromatic monocarboxylic acids. The blended amounts of the various constituents in the calcium complex soap pertaining to the present embodiment are given by way of examples in more detail below.

The blended amount of higher fatty acids in the calcium complex soap, taking the total grease composition as 100 parts by mass, may be 0.5 to 22 parts by mass, but more preferably 1 to 18 parts by mass and yet more preferably 2 to 15 parts by mass.

The blended amount of aromatic monocarboxylic acids in the calcium complex soap, taking the total grease composition as 100 parts by mass, may be 0.05 to 5 parts by mass, but more preferably 0.1 to 4 parts by mass and yet more preferably 0.5 to 3 parts by mass.

The blended amount of lower fatty acids in the calcium complex soap, taking the total grease composition as 100 parts by mass, may be 0.15 to 7 parts by mass, but more preferably 0.5 to 6 parts by mass and yet more preferably 1 to 5 parts by mass.

The proportion of the calcium complex soap in relation to the base oil as a mass ratio is preferably of the order of 99:1 to 60:40, but more preferably of the order of 97:3 to 70:30, and yet more preferably of the order of 95:5 to 80:20.

The proportion of the higher fatty acids in relation to the total amount of carboxylic acids is preferably of the order of 70:30 to 62:38, but more preferably of the order of 69:31 to 64:36 and yet more preferably of the order of 68:32 to 65:35.

The proportion of the aromatic monocarboxylic acids in relation to the total amount of carboxylic acids as a mass ratio is preferably of the order of 98:2 to 83:17, but more preferably of the order of 96:4 to 84:16, and yet more preferably of the order of 95:5 to 85:15.

The proportion of the lower fatty acids in relation to the total amount of carboxylic acids as a mass ratio is preferably of the order of 90:10 to 76:24, but more preferably of the order of 89:11 to 80:20, and yet more preferably of the order of 88:12 to 83:17.

The proportion of the aromatic monocarboxylic acids in relation to the higher fatty acids as a mass ratio is preferably of the order of 97:3 to 70:30, but more preferably of the order of 95:5 to 75:25, and yet more preferably of the order of 92:8 to 78:22. If the proportion of aromatic monocarboxylic acids exceeds 30%, the grease structure will not form, and if it is below 3% it is believed thermal resistance will not be imparted.

The proportion of the lower fatty acids in relation to the higher fatty acids as a mass ratio is preferably of the order of 85:15 to 65:35, but more preferably of the order of 82:18 to 70:30, and yet more preferably of the order of 80:20 to 72:28. If the proportion of lower fatty acids exceeds 35%, the grease structure will not form, and if it is below 15% it is believed thermal resistance will not be imparted.

The proportion of the lower fatty acids in relation to the aromatic monocarboxylic acids as a mass ratio is preferably of the order of 53:47 to 10:90, but more preferably of the order of 51:49 to 15:85, and yet more preferably of the order of 50:50 to 20:80. If the proportion of lower fatty acids exceeds 90 mass %, it is believed that the effect of the thickening agent will be weak and a grease structure will not form.

The grease composition of the present embodiment may be manufactured by the grease manufacturing methods normally carried out. The method of manufacture is not specially limited but, as an example, the higher fatty acids (a mixture which includes behenic acid), the lower fatty acids and the aromatic monocarboxylic acids are mixed with the base oil in a grease-preparation kettle and the contents dissolved at a temperature of 60 to 120° C. Next, calcium hydroxide previously dissolved and dispersed in a suitable amount of distilled water is added to the aforementioned kettle. The carboxylic acids and the basic calcium (typically calcium hydroxide) undergo a saponification reaction so that gradually a soap is formed in the base oil, and by applying further heat to complete dehydration the grease thickening agent is formed. Once dehydration has been completed, heat is applied up to a temperature of 180 to 220° C. and once sufficient agitation and mixing have been achieved, it is left to cool to room temperature. Then a disperser (for example a three-roll mill) is used to obtain a homogeneous grease composition.

Penetration

In penetration tests, the grease of the present embodiment will preferably have a penetration of No. 1-No. 4 (175-340), but more preferably No. 2-No. 3 (220-295). The penetration denotes the apparent hardness of the grease. In this case the worked penetration may be determined in accordance with JIS K2220 7.

Dropping Point

The grease composition of the present embodiment will preferably have a dropping point of or in excess of 200° C., but more preferably of or in excess of 220° C. and especially preferably of or in excess of 260° C. Provided the dropping point of the grease composition is at least 180° C. (a temperature at least 50° C. higher than normal calcium greases), it is believed that it is possible to inhibit the possibility of lubrication problems occurring, for example loss of viscosity at high temperatures and subsequent leaking, or welding). The dropping point refers to the temperature for a grease having viscous characteristics at which the structure of the thickening agent will be lost if the temperature is exceeded). In this case the dropping point may be determined in accordance with JIS K2220 8.

Low-Temperature Characteristics

The penetration difference (unworked penetration (25° C.)-low-temperature penetration (−20° C.)) of the grease of the present embodiment in temperature/penetration tests (−20° C.) is preferably not more than 130, but more preferably not more than 120. If the aforementioned penetration difference is greater than 130, the flow characteristics of the grease will be poor and lubrication functions will be lost in low-temperature environments, so that for example the starting torque in bearings will be huge, which will involve energy losses and faults when starting up machinery. It is desirable therefore to have a state where the grease penetration is soft and the lubrication properties are maintained even at low temperatures. In this case the unworked penetration may be determined in accordance with JIS K2220 7.

Bearing Life

In greased bearing life tests (150° C.), the grease composition of the present embodiment preferably has a lifetime of not less than 350 hours, but more preferably not less than 400 hours and even more preferably not less than 450 hours. In the bearing life test, 6.0 g of sample grease is sealed in a 6306-type deep-groove ball bearing which is operated in a cycle of running for 20 hours at 150° C. and stopping for 4 hours. The apparatus is such that, eventually, the lubricating function is lost and rotation of the bearing becomes unsatisfactory and once the electrical current of the motor driving the bearing exceeds a certain point it stops. The grease life is recorded by reading off the time at which the motor stopped. The lubricating life of a grease very much depends on the physical behaviour of the grease and chemical ageing. In either case, if functions are lost the lubricating life is profoundly affected. For example, if a grease becomes liquid at high temperatures or softens to a significant degree because of shear within the bearing, grease will leak from the bearing, supply of lubricant oil will be impossible and lifetimes will diminish. Also, in the event that evaporation of the grease itself is excessive or the environment in which it is used reaches a high temperature, the grease will be significantly subject to the effects of the heat and oxidative ageing will develop. The grease will harden or soften because of increases in the viscosity of the base oil component, the production of sludge or changes in the structure of the thickening agent, which will quickly impact on lubricating life. Consequently, greases with a long lubricating life in which it is possible to maintain the physical behaviour of the grease and a stable lubrication state with little chemical ageing have a wide appeal commercially, given that they can improve reliability of machinery and extend maintenance periods, and can also be used in high-temperature environments. Determination of the grease lubrication life in this case may be carried out in accordance with the bearing life test of ASTM D1741.

The grease composition of the present embodiment can be employed not only in commonly used machines, bearings and gears but can also exhibit its superior performance under more severe conditions. For example, it can be used satisfactorily for lubrication, in automobiles, of engine peripherals such as starters, alternators and various actuator components, propeller shafts, constant velocity joints (CVJ), wheel bearings and powertrain components such as clutches, and in various parts such as electrical power steering (EPS), brake devices, ball joints, door hinges, handles, cooling fan motors and brake expanders. In addition, it can preferably be used also at points subject to high temperatures and high loads as in construction machinery such as power shovels, bulldozers and truck cranes, in the iron and steel industry, in the papermaking industry, in the forestry industry, in agricultural machinery, in chemical plant, in power stations, in drying furnaces, in photocopiers, in railway rolling stock and in seamless pipe threaded joints. Other applications such as hard-disc bearing uses, plastic lubrication uses and cartridge greases may also be mentioned: use in these applications, too, is ideal.

EXAMPLES

The invention is described in more detail below by using examples of embodiment and comparative examples, but it is not in any way limited by these examples.

The raw materials used in the examples of embodiment and comparative examples were as follows. Unless specifically noted, the component quantities in Example of Embodiment 1 to Example of Embodiment 3 and Comparative Examples 1 to 4 were as recorded in Table 1 below. The amounts for the raw materials shown in Table 1 {in particular for the calcium hydroxide and carboxylic acids (higher fatty acids, aromatic monocarboxylic acids and lower fatty acids)} are the quantities of reagent. The actual amounts of components in the composition are therefore calculated on the basis of the numerical values in Table 1 and the purities given below.

Thickener Raw Materials

Calcium hydroxide: special grade of purity 96.0%.

Stearic acid: C18 straight-chain alkyl saturated fatty acid, special grade, purity 95.0%.

Behenic acid: C22 straight-chain alkyl saturated fatty acid, special grade, purity 99.0%.

Benzoic acid: special grade, purity 99.5%.

Acetic acid: alkyl fatty acid having a carbon number of 2, special grade, purity 99.7%.

Base oil A

Base Oil A: paraffinic mineral oil obtained by dewaxing and solvent refining, belonging to Group 1, kinematic viscosity @ 100° C. 11.25 $mm^2/s$, viscosity index 97.

Example of Embodiment 1

As raw materials, base oil A along with stearic acid, behenic acid, benzoic acid and acetic acid were mixed in a grease-preparation kettle which was heated to 90° C. to dissolve the contents. Then calcium hydroxide previously dissolved and dispersed in a suitable amount of distilled water was introduced into the kettle. The calcium hydroxide at this point underwent a saponification reaction with the carboxylic acids and gradually a soap was formed in the base oil. Dehydration was completed by further heating so that a grease thickening agent was produced. Once dehydration was complete, the grease was heated to a temperature in excess of 200° C., and after sufficient agitation and mixing it was left to cool to room temperature. Then, by using a three-roll mill, a homogeneous grease of No. 3 penetration was obtained.

Example of Embodiment 2

In similar fashion to Example of Embodiment 1, along with base oil A, stearic acid, behenic acid, benzoic acid and acetic acid were mixed as the raw materials in a grease-preparation kettle and a homogeneous grease of No. 3 penetration was obtained.

Example of Embodiment 3

In similar fashion to Example of Embodiment 1, along with base oil A, stearic acid, behenic acid, benzoic acid and acetic acid were mixed as the raw materials in a grease-preparation kettle and a homogeneous grease of No. 3 penetration was obtained.

Comparative Example 1

As raw materials, base oil A along with stearic acid, benzoic acid and acetic acid were mixed in a grease-preparation kettle which was heated to 90° C. to dissolve the contents. Then calcium hydroxide previously dissolved and dispersed in a suitable amount of distilled water was introduced into the kettle. The calcium hydroxide at this point underwent a saponification reaction with the carboxylic acids and gradually a soap was formed in the base oil. Dehydration was completed by further heating so that a grease thickening agent was produced. Once dehydration was complete, the grease was heated to a temperature in excess of 200° C., and after sufficient agitation and mixing it was left to cool to room temperature. Then, by using a three-roll mill, a homogeneous grease of No. 3 penetration was obtained.

Comparative Example 2

In similar fashion to Comparative Example 1, along with base oil A, stearic acid, behenic acid, benzoic acid and acetic acid were mixed as the raw materials in a grease-preparation kettle and a homogeneous grease of No. 3 penetration was obtained.

Comparative Example 3

In similar fashion to Comparative Example 1, along with base oil A, stearic acid, behenic acid, benzoic acid and acetic acid were mixed as the raw materials in a grease-preparation kettle and a homogeneous grease of No. 3 penetration was obtained.

Comparative Example 4

In similar fashion to Comparative Example 1, along with base oil A, behenic acid, benzoic acid and acetic acid were mixed as the raw materials in a grease-preparation kettle and a homogeneous grease of No. 3 penetration was obtained.

Comparative Example 5

In similar fashion to Comparative Example 1, along with base oil A, stearic acid and acetic acid were mixed as the raw materials in a grease-preparation kettle and a homogeneous grease of No. 2.5 penetration was obtained.

Comparative Example 6

This was a commercial lithium-based grease (made by Showa Shell Sekiyu Ltd.) and the thickening agent was a 12-hydroxystearate soap, and a mineral oil was used for the base oil. The viscosity of the base oil was 6.2 $mm^2/s$ at 100° C.

The penetration, dropping point and bearing life of the grease compositions prepared using the above raw-material constituents and methods were measured by the methods explained earlier. The results were as shown in Table 1. On the basis of these results, it was evident that the grease compositions pertaining to the present examples of embodiment maintained a high dropping point and thermal resistance, and also showed a considerable improvement in bearing life and had low-temperature characteristics. Accordingly, it will be possible greatly to increase the grease functions themselves but also the confidence of improvements in maintaining machinery.

As can be seen from Tables 1 and 2, Comparative Examples 1 and 2 (where the proportion of mass occupied by behenic acid in the long-chain fatty acids is below 25%) have insufficient bearing life, and Comparative Examples 3 and 4 (where the proportion of mass occupied by behenic acid in the long-chain fatty acids exceeds 70%) exhibit hardening of the grease at low temperatures. Further, in the cases of Comparative Example 5 (a conventional calcium complex grease) and Comparative Example 6 (a commercial lithium grease) the bearing life is short and they do not have durability. In contrast, the examples of embodiment of the invention all have stable lubricating functions in a broad temperature domain from the twin standpoints of bearing life and low temperature characteristics.

TABLE 1

| | | Ex. 1 | Ex 2 | Ex. 3 | Comp Ex 1 |
|---|---|---|---|---|---|
| Alkali | $Ca(OH)_2$ | 4.04 | 4.01 | 3.94 | 4.10 |
| Long-chain fatty acids | Stearic acid | 7.13 | 5.54 | 3.24 | 10.30 |
| | Behenic acid | 3.20 | 4.80 | 7.20 | |
| Short-chain fatty acid | Acetic acid | 3.20 | 3.21 | 3.23 | 3.21 |
| Aromatic monocarboxylic acid | Benzoic acid | 1.46 | 1.46 | 1.47 | 1.46 |
| Thickeners in total | | 19.03 | 19.02 | 19.08 | 19.07 |
| Base oil A | | 80.97 | 80.98 | 80.92 | 80.93 |
| Total | | 100.00 | 100.00 | 100.00 | 100.00 |
| Behenic acid/ling-chain fatty acids, Mass ratio % | | 31 | 46 | 69 | 0 |
| Penetration, 25° C. | Unworked | 224 | 222 | 227 | 238 |
| | Worked | 229 | 226 | 228 | 245 |
| | NLGI grade | No. 3 | No. 3 | No. 3 | No. 3 |
| Dropping point | ° C. | >260 | >260 | >260 | >260 |
| Low temp characteristics, low temp. penetration, −20° C. | Evaluation | ○ | ○ | ○ | ○ |
| | Penetration difference* | 109 | 117 | 123 | 126 |
| Bearing life ASTM D1741, 140° C. | Evaluation | ○ | ○ | ○ | Δ |
| | h | 460 | 480 | 480 | 360 |
| Overall evaluation | | ○ | ○ | ○ | Δ |

TABLE 2

| | | Comp Ex 1 | Comp Ex 2 | Comp Ex 3 | Com Ex 4 | Comp Ex 5 | Comp Ex 6 |
|---|---|---|---|---|---|---|---|
| Alkali | $Ca(OH)_2$ | 4.10 | 4.06 | 3.96 | 3.91 | 4.35 | Commerical lithium grease |
| Long-chain fatty acids | Stearic acid | 10.30 | 7.92 | 2.39 | | 11.86 | |
| | Behenic acid | | 2.40 | 8.05 | 10.47 | | |
| Short-chain fatty acid | Acetic acid | 3.21 | 3.21 | 3.23 | 3.23 | 3.79 | |
| Aromatic monocarboxylic acid | Benzoic acid | 1.46 | 1.46 | 1.47 | 1.47 | | |
| Thickeners in total | | 19.07 | 19.05 | 19.10 | 19.08 | 20.00 | |
| Base oil A | | 80.93 | 80.95 | 80.90 | 80.92 | 80.00 | |
| Total | | 100.00 | 100.00 | 100.00 | 100.00 | 100.00 | |
| Behenic acid/ling-chain fatty acids Mass ratio % | | 0 | 23 | 77 | 100 | — | |
| Penetration, 25° C. | Unworked | 238 | 230 | 228 | 228 | 245 | 245 |
| | Worked | 245 | 235 | 230 | 228 | 258 | 251 |
| | NLGI grade | No. 3 | No. 3 | No. 3 | No. 3 | No. 2.5 | No. 2.5 |

TABLE 2-continued

| | | Comp Ex 1 | Comp Ex 2 | Comp Ex 3 | Com Ex 4 | Comp Ex 5 | Comp Ex 6 |
|---|---|---|---|---|---|---|---|
| Dropping point | ° C. | >260 | >260 | >260 | >260 | 190 | 190 |
| Low temp characteristics, low temp. penetration, −20° C. | Evaluation | ○ | ○ | x | x | Δ | ○ |
| | Penetration difference* | 126 | 125 | 144 | 158 | 135 | 118 |
| Bearing life ASTM D1741, 140° C. | Evaluation | Δ | Δ | ○ | ○ | x | x |
| | h | 360 | 380 | 510 | 540 | 270 | 190 |
| Overall evaluation | | Δ | Δ | Δ | Δ | x | Δ |

That which is claimed is:

1. A grease composition comprising:

(a) a base oil; and (b) a calcium complex soap thickener content ranging from 5 mass % to 20 mass %, by mass of the grease composition, wherein the calcium complex soap thickener is a reaction product of a plurality of carboxylic acids and a calcium hydroxide, the plurality of carboxylic acids comprising:

(i) 2 mass % to 15 mass % of a C18-C22 straight chain higher fatty acids having a behenic acid content ranging from 25 mass % to 70 mass %, by mass of the C18-C22 straight chain higher fatty acids;

(ii) 0.5 mass % to 3 mass % of an aromatic monocarboxylic acids comprising substituted or unsubstituted benzene rings, and (iii) 1 mass % to 5 mass % of a C2-C4 straight-chain saturated lower fatty acids.

2. The grease composition in accordance with claim 1, wherein the plurality of carboxylic acids has a greater concentration of the C18-C22 straight-chain higher fatty acids than of the C2-C4 straight-chain saturated lower fatty acids, and wherein the plurality of carboxylic acids has a greater concentration of the C2-C4 straight-chain saturated lower fatty acids than of the aromatic monocarboxylic acids.

3. The grease composition in accordance with claim 1, wherein the C18-C22 straight chain higher fatty acids comprise one or more of stearic acid, oleic acid and 12-hydroxystearic acid.

4. The grease composition in accordance with claim 1, wherein the aromatic monocarboxylic acids comprises one or more of acetic acid and butyric acid, and wherein the C18-C22 straight chain higher fatty acids further comprise stearic acid at a mass ratio of stearic acid to behenic acid ranging from 75:25-30:70.

5. The grease composition in accordance with claim 1, wherein the aromatic monocarboxylic acids are selected from the group consisting of benzoic acid, methylbenzoic acid, toluic acid, dimethylbenzoic acid, xylylic acid, hemellitc acid, mesitylenic acid, trimethylbenzoic acid, prehnitylic acid, durylic acid, isodurylic acid, 4-isopropylbenzoic acid, hydroxybenzoic acid, dihydroxybenzoic acid, pyrocatachuic acid, resorcylic acid, gentisic acid, protocatechuic acid, trihydroxybenzoic acid, hydroxy-methylbenzoic acid, cresotic acid, dihydroxy-methylbenzoic acid, orsellinic acid, methoxybenzoic acid, anisic acid, dimethoxybenzoic acid, trimethoxybenzoic acid, hydroxy-methoxybenzoic acid, vanillic acid, isovanillic acid, and hydroxydimethoxybenzoic acid.

6. The grease composition in accordance with claim 1, wherein the C2-C4 straight-chain saturated lower fatty acids are selected from the group consisting of acetic acid, propionic acid, and butyric acid.

7. The grease composition in accordance with claim 1, wherein the C18-C22 straight chain higher fatty acids comprise one or more of a stearic acid, an oleic acid, arachidinic acid, heneicosanoic acid, 12-hydroxystearic acid, oleic acid, linolenic acid, gadoleic acid, eicosadienoic acid, mead acid, erucic acid, and docosadienoic acid.

* * * * *